US005467492A

United States Patent [19]

Chao et al.

[11] Patent Number: 5,467,492

[45] Date of Patent: Nov. 21, 1995

[54] DRY-CLEANING OF GARMENTS USING LIQUID CARBON DIOXIDE UNDER AGITATION AS CLEANING MEDIUM

[75] Inventors: Sidney C. Chao, Manhattan Beach; Thomas B. Stanford, San Pedro; Edna M. Purer, Los Angeles; Angela Y. Wilkerson, Inglewood, all of Calif.

[73] Assignee: Hughes Aircraft Company, Los Angeles, Calif.

[21] Appl. No.: 236,776

[22] Filed: Apr. 29, 1994

[51] Int. Cl.[6] ..... D06B 15/09

[52] U.S. Cl. ..... 8/159; 68/207; 68/183; 68/3 SS

[58] Field of Search ..... 68/18 C, 207, 68/3 SS, 183; 8/159, 158; 134/107, 108, 184, 193

[56] References Cited

U.S. PATENT DOCUMENTS

| | | | |
|---|---|---|---|
| 2,985,003 | 5/1961 | Gelfand et al. | 134/184 |
| 3,086,538 | 4/1963 | Voltz | 134/193 UX |
| 3,712,085 | 1/1973 | Guberman et al. | 68/18 C X |
| 4,012,194 | 3/1977 | Maffei | 8/142 |
| 4,443,111 | 4/1984 | Minaire | 68/207 X |
| 4,727,734 | 3/1988 | Kanazawa | 68/3 SS |
| 4,936,922 | 6/1990 | Cherry . | |
| 5,158,100 | 10/1992 | Tanaka et al. | 134/902 X |
| 5,226,969 | 7/1993 | Watanabe et al. | 134/193 X |
| 5,267,455 | 12/1993 | Dewees et al. | 68/5 C |
| 5,279,615 | 1/1994 | Mitchell et al. | 8/142 |

*Primary Examiner*—Frankie L. Stinson

*Attorney, Agent, or Firm*—M. E. Lachman; M. W. Sales; W. K. Denson-Low

[57] ABSTRACT

Liquid carbon dioxide, in combination with agitation and, optionally, with process enhancers, such as surfactants, and solvents, such as water, is used to remove contaminants from garments or fabrics. Both apparatus and process are disclosed. Carbon dioxide-cleaned garments are rendered free of odor, require no drying, and the cost per unit solvent (by weight) is a fraction of that of conventional solvents.

19 Claims, 3 Drawing Sheets

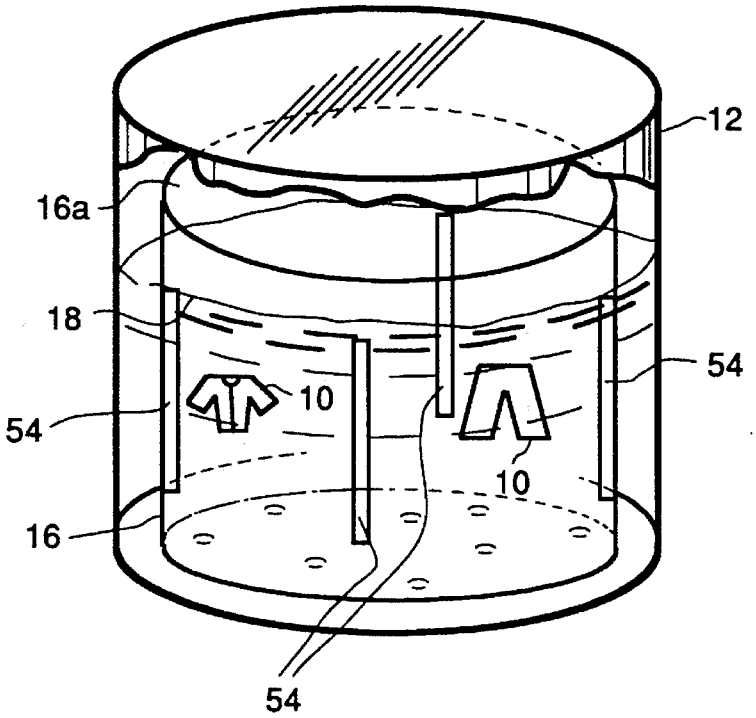
FIG. 4.
FIG. 5.
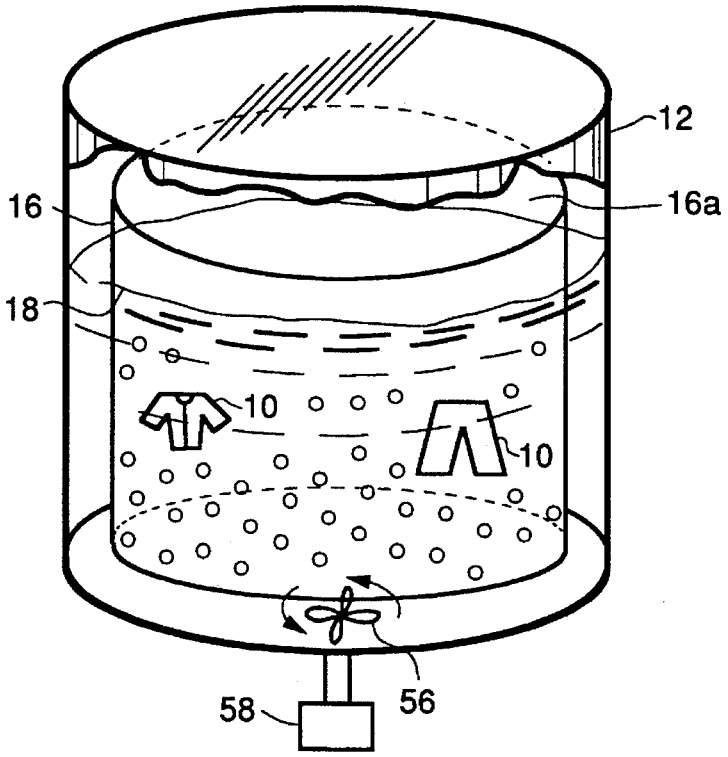

DRY-CLEANING OF GARMENTS USING LIQUID CARBON DIOXIDE UNDER AGITATION AS CLEANING MEDIUM

BACKGROUND OF THE INVENTION

1. Field of the Invention

The present invention is related generally to a method for dry-cleaning garments or fabrics, and, more particularly, to such method, using liquid carbon dioxide as a solvent, alone, or along with surfactants or organic solvents, together with mechanical or sonic agitation in order to enhance the removal of insoluble/particulate soils.

2. Description of Related Art

A typical dry-to-dry-cleaning process consists of a wash, rinse, and drying cycle with solvent recovery. The garments are loaded into the cleaning drum and the cleaning fluid from a base tank is pumped into the drum to a predetermined level. During the wash and the rinse cycles, the drum tumbles the garments to provide the necessary agitation for soil removal. The solvent is then spun out of the drum and returned to the base tank through the appropriate filtration system. Some new machines use a closed loop system for solvent circulation during the wash cycle. The solvent is circulated continuously and at a high rate through the cleaning drum via a battery of filters. The high flow rates aid the rapid soil removal from the drum and result in lower soil re-deposition. At regular intervals, the cleaning fluid must undergo a distillation step to remove the dissolved soils and dyes. The stills are either part of the dry-cleaning machine itself, or self-standing.

Currently, the dry-cleaning industry uses perchloro-ethylene (PCE) (225 million pounds/year, 85% of establishments), petroleum-based or Stoddard solvents (55 million pounds/year, 12% of establishments), CFC-113 (11 million pounds/year, <2% of establishments) and some 1,1,1-trichloroethane.

The dry-cleaning industry usually operates out of small, neighborhood-type shops. As such, the dry cleaners make up one of the largest groups of chemical users that come into direct contact with the general public.

All the solvents used present health risks, safety risks, and are environmentally detrimental: PCE is a suspected carcinogen, petroleum-based solvents are flammable and smog-producing, and CFC-113 is an ozone depletor and targeted to be phased out by the end of 1995.

Health risks due to exposure to cleaning solvents and the high costs of implementing and complying with safety and environmental restrictions and regulations have made dry-cleaning a much more difficult business in which to achieve profitability. For these reasons, the dry-cleaning industry is engaged in an ongoing search for alternative, safe, and environmentally "green" cleaning technologies, substitute solvents and methods to control exposure to dry-cleaning chemicals.

U.S. Pat. No. 5,267,455, as augmented by U.S. Pat. No. 5,279,615, discloses a dry-cleaning process for garments using both liquid and supercritical carbon dioxide as a cleaning medium, with or without the aid of cleanliness enhancing additives, along with a rotatable inner drum magnetically coupled to an electric motor.

Agitation of garments in a cleaning medium accelerates removal of soluble soils and is essential in the removal of particulate (insoluble) soils. However, the problems involved in fabricating a pressurized cleaning chamber with highly loaded internal moving parts, such as rotatable drum (as referenced above), and mainly the high costs associated with those problems, limit the commercial acceptability of such a process. This is particularly so for a neighborhood industry, such as dry-cleaning, where competition is high and profit margins are low to begin with.

Thus, there is a need for a method of dry-cleaning that employs health and environmentally-safe cleaning fluids at a competitive cost relative to the existing operations.

SUMMARY OF THE INVENTION

In accordance with the present invention, liquid carbon dioxide, in combination with agitation (gas, sonic, liquid) is used to accelerate soluble soil removal and to promote particulate soil removal from garments or fabrics. The apparatus comprises:

(a) a walled vessel for containing liquid carbon dioxide to withstand pressures adequate to maintain carbon dioxide in liquid state, at typical ambient process temperatures of about 0° to 30° C., and at typical process pressures of about 500 to 1,000 pounds per square inch (psi) (35.2 to 70.3 $Kg/cm^2$);

(b) an inlet means attached to the walled vessel for introducing the liquid carbon dioxide thereinto;

(c) reservoir means for supplying the liquid carbon dioxide to the inlet means;

(d) means, such as a sampling valve, for introducing a surfactant or co-solvent (such as water) into the walled vessel;

(e) a perforated and lidded basket within the walled vessel for containing the fabrics and garments to be cleaned;

(f) means (gas, sonic, and/or liquid) for directly agitating the liquid carbon dioxide in the walled vessel to thereby agitate the garments and fabrics in the perforated lidded drum;

(g) a liquid level gauge/controller for controlling the level of the liquid carbon dioxide in the walled vessel;

(h) temperature control means associated with the walled vessel for controlling the temperature of the liquid carbon dioxide therewithin;

(i) pressure control means associated with the walled vessel for controlling the pressure of the liquid carbon dioxide therewithin; and (j) outlet means in the walled vessel for removing the liquid carbon dioxide therefrom.

Although higher temperatures and pressures can be utilized, the lowest pressure necessary to maintain the carbon dioxide in liquid state at the process temperature is usually selected, to reduce equipment and energy costs.

In the practice of the present invention, the soiled garments and fabrics are placed in the perforated basket; the liquid carbon dioxide is introduced in the walled vessel to a preset level along with an appropriate surfactant to submerge the garments and fabrics therein; the garments are exposed to the cleaning fluid and are simultaneously agitated to accelerate soluble soil removal and promote particulate soil dislodging, surfactant foaming, and particulate soil "capture"; the vessel is then flooded to remove the particulate soil "loaded" surfactant and a "rinse" flow-through step initiated to reduce soil redeposition. At the end of the cleaning cycle, the liquid is boiled off and the walled vessel decompressed while maintaining ambient temperature to avoid cold garments and thus, moisture condensation.

Carbon dioxide-cleaned garments are rendered odor-free, require no drying, and the cost per unit solvent (by weight) is a fraction of that of conventional solvents.

BRIEF DESCRIPTION OF THE DRAWINGS

FIG. 4 is a schematic view of a cleaning vessel for dry-cleaning garments and fabrics, used with the apparatus of FIG. 1 and employing as an agitation means sonic nozzles alone, or in conjunction with the two previous means described above; and FIG. 5 is a schematic view of a cleaning vessel for dry-cleaning garments and fabrics, used with the apparatus of FIG. 1 and employing an impeller for agitating the cleaning liquid, above, or in conjunction with one or more of the means described above.

DESCRIPTION OF THE PREFERRED EMBODIMENTS

Figure 1:
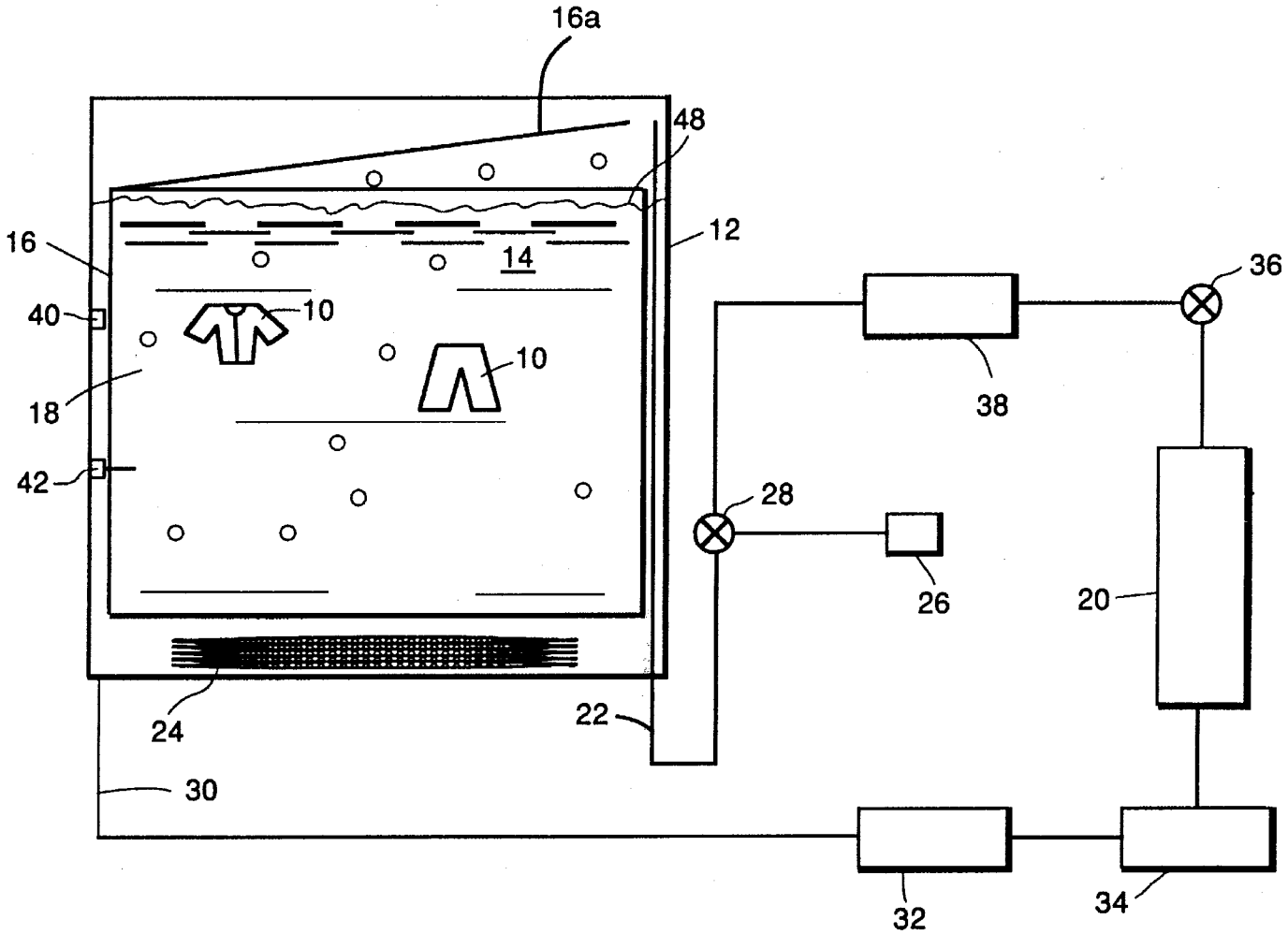
FIG. 1 is a schematic diagram, partly in section, of the supporting apparatus for the walled vessel(s) employed in the practice of the current invention.

In order to minimize or eliminate the use of combustible, smog-producing, ozone-depleting, and hazardous chemicals, liquefied gases, such as carbon dioxide with good solvating properties, can be used as a dry-cleaning medium for fabrics and garments along with low concentrations of cleaning enhancers such as surfactants and/or solvents. Liquid carbon dioxide is non-toxic, non-ozone-depleting, non-flammable, inexpensive, and unlimited natural resource with excellent solvating properties. Upon decompression from liquid to gaseous state, carbon dioxide loses its solvating properties and the extracted/solvated materials drop out in a concentrated form, allowing either re-use or simplified disposal.

The present invention employs a dry-cleaning "washing machine" where the cleaning media is "vigorously" agitated liquid carbon dioxide, in conjunction with low levels (less than 5% by weight) of cleaning additives, or enhancers, such as surfactants and/or solvents. Typical cleaning additives useful in the practice of the present invention include, but are not limited to, anionic and non-ionic surfactants, including, but not limited to, alkyl benzene sulfonates, alkyl benzene sulfates, olefin sulfonates, olefin sulfates, ethoxylated alkyl phenols, and ethoxylated fatty alcohols. Water is advantageously employed as the solvent.

Turning now to the drawings, wherein like reference numerals designate like elements, the fabrics and garments 10 to be cleaned are loaded into a pressurizable vessel 12. Within the pressurizable vessel 12 is a perforated cleaning drum 16. Liquid carbon dioxide 18 is pumped into the walled vessel 12 from a storage tank 20.

FIG. 1 depicts the overall system of the present invention. The perforated cleaning drum 16 is provided with a lid **16*a* to contain the garments 10** during processing.

Liquid carbon dioxide 18 is supplied from a pressurized reservoir 20 through inlet 22. The vessel 12 is further equipped with a heater 24 to aid in temperature control for maintaining the "boiling" liquid $CO_2$ phase during cleaning. Also, the vessel 12 is equipped with agitation means, not shown in FIG. 1, but variously depicted in FIGS. 2–5.

During operation, the vessel 12 is loaded with the garments and/or fabrics 10 and then charged with liquid carbon dioxide 18 and cleaning enhancer 26 through the inlet 22. A sampling valve 28 is used to introduce the cleaning enhancer 26 into the inlet line 22.

Once charged with liquid carbon dioxide 18, agitation is applied to clean the garments 10, to speed up cleaning in general, to aid in the removal of the insoluble particulates, and the reduce the possibility of re-deposition of contaminants. The contaminated or "loaded" surfactant and liquid carbon dioxide is then removed from the vessel 12 through outlet 30 and is decompressed into a separator 32 that is equipped with the appropriate filtration system (to remove the insoluble particulates). Upon decompression, the carbon dioxide loses its solvating characteristics and the particulates and any cleaning enhancers drop out into the separator in a concentrated form, while the clean gaseous carbon dioxide is returned to the storage tank 20 via a condenser 34, where it is reliquefied. In the flow-through mode, this process is continuous, as a pump 36 will move the liquid continuously from the storage tank 20 into the walled vessel 12 and back into the storage tank 20 via the route described above. A preheater 38 between the pump 36 and vessel 12 aids in the temperature control of the circulating liquid carbon dioxide 18. Pressure control means, such as a pressure gauge (40), and temperature control means, such as a thermocouple (42), are used to control the pressure and temperature, respectively, of the liquid carbon dioxide, as is well-known.

Typical pressures contemplated for the process described herein range from about 500 to 1,000 psi (35.2 to 70.3 $Kg/cm^2$), with typical temperatures within the range of about 0° to 30° C. However, the upper limit of the temperature is increased somewhat by the addition of up to about 5 wt % of cleaning enhancers, e.g., surfactants and/or solvents, and may approach 50° C. While the pressure may also be higher than 1,000 psi (70.3 $Kg/cm^2$), and may approach 1,500 psi (105.4 $Kg/cm^2$) it is preferred that the lowest pressure necessary to maintain the carbon dioxide in liquid state at the process temperature be employed, so as to reduce equipment and energy costs.

Insoluble soil particulates deposit on fabrics/garments from dust-laden atmospheres or by contact with soiled or dusty surfaces. While the cleaning additives used and their concentration will affect the amount of insoluble soil removed, the most important factor in the removal of insoluble (particulate) soils is agitation. This can be achieved by various means, which are described below. It will be appreciated that the aspects of the apparatus that have nothing to do with agitation, such as the reservoir 20, inlet port 22, outlet port 30, preheater 38, and the like have been omitted from the following description and the Figures associated therewith. However, these various aspects are present in each instance.

Figure 2:
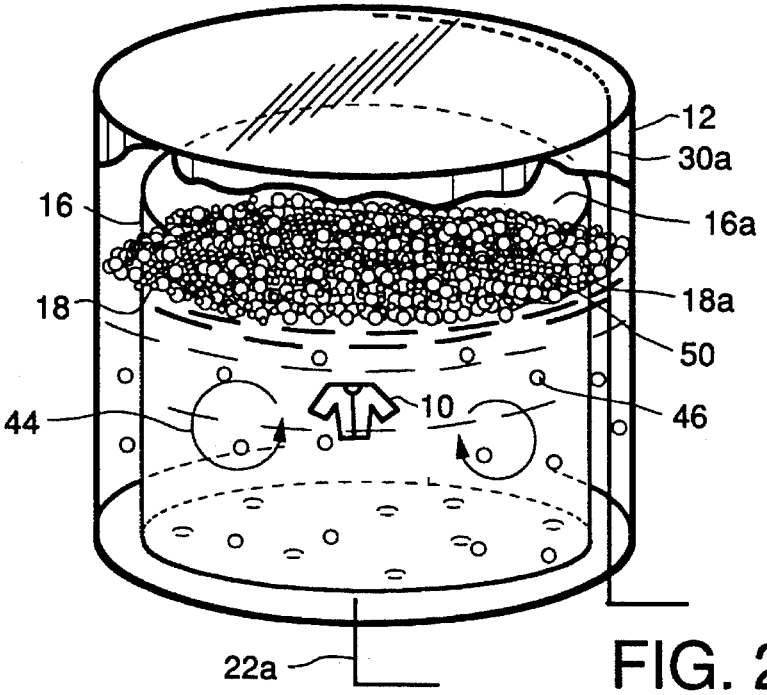
FIG. 2 is a schematic view of a cleaning vessel for dry-cleaning garments and fabrics, used with the apparatus of FIG. 1 and employing as a garment agitation means carbon dioxide bubbles generated by processing at the liquid $CO_2$ boiling temperature(s) for the pressure(s) selected.

"Gas bubble"/boiling agitation:

Vigorous garment and fabric agitation may be achieved in flow-through mode as illustrated in FIG. 2. The garment-loaded walled vessel 12 is pressurized to preset levels (i.e., 850 psi, 59.8 Kg/cm$^2$) and the temperature raised to the boiling point at this pressure (i.e., 21° C.). The rate of incoming fluid through bottom inlet 22*a* is balanced with the "boil-off" to maintain the liquid level within a preset range. The evolving gas bubbles within the boiling mass initiate garment agitation and tumbling necessary for particulate soil dislodging. "Boiling" is indicated by the convective arrows 44 and gas bubbles 46. The level of the liquid carbon dioxide 18 within the walled vessel 12 is maintained below the basket lid 16*a* of the perforated basket 16 to allow the garments 10 to tumble freely without being forced against the lid. A liquid level sensor 48 (not shown in FIG. 2, but shown in FIG. 1) is used to control the liquid level.

The cleaning enhancer or additive 26 is introduced with the incoming $CO_2$ 18 after the boiling is initiated to accelerate its dispersion and foaming. When the cleaning additive 26 is of a foaming type, the foam 50 traps the particulate soils and floats on top of the liquid phase 18 during the first phase of the cleaning. At first, the $CO_2$ is evacuated through outlet 30*a*, which extends into the gas phase above the froth level in order to preserve it while agitating. At the end of the agitation cycle, the liquid level 18*a* is raised all the way to the outlet 30*a* to force-evacuate the loaded foam 50.

Although not shown, the internal lid configuration is such as to promote foam evacuation (slanted or domed, for example). The agitation-foaming/foam evacuation step can be repeated as necessary. After the foam evacuation step, the flow is reversed through external automated valves (not shown): The liquid is introduced from the top through 30*a* and eluted from the bottom through 22*a*, thus producing a "rinse" cycle where the top-to-bottom flow will aid in the evacuation of residual dislodged/dissolved soils. "Boiling" may be continued at this stage also. At the end of the cycle, the liquid carbon dioxide within the walled vessel 12 is "boiled off"/evacuated. The temperature within the vessel 12 is maintained at ambient levels during decompression to avoid cold garments that would promote undue moisture adsorption/condensation.

When non-foaming cleaning additives 26 are used, the chamber "flooding" for foam evacuation is omitted.

Alternatively, the above process can be performed by pressure cycling in flow-through between two pressures, i.e., 850 psi (59.8 Kg/cm$^2$) and 500 psi (35.2 Kg/cm$^2$), with a rapid drop while maintaining temperatures that promote boiling at both pressures (i.e., ~20° C. and ~1° C., respectively). The pressure gauge 40 and thermocouples 42 are not shown.

Although FIG. 2 illustrates a vertical configuration of the walled vessel 12, the horizontal configuration is preferred, as it is more operator/user friendly.

The advantage of the cleaning process and vessel described above is in the simple design that does not require moving parts and, thus, it is less costly to fabricate and maintain. The cleaning action is accomplished by taking advantage of a physical phenomenon, such as the boiling of the cleaning medium.

Preliminary particulate soil removal experiments were performed with lint-free white cotton and fine polyester samples, heavily soiled with 1 to 80 μm Fine Arizona Road Dust. The samples were exposed to a vigorously "boiling" liquid carbon dioxide between 800 psi (59.8 Kg/cm$^2$)/22° C. and 300 psi (21.1 Kg/cm$^2$)/−18° C. in a continuous cycle with a ~20 minute total "boiling" time. Upon decompression, the samples were examined visually and under the microscope and compared to reference soiled samples. All processed samples showed significant improvement in cleanliness without fabric degradation. No attempt was made at this time to optimize the cleaning process.

Liquid Agitation

Figure 3:
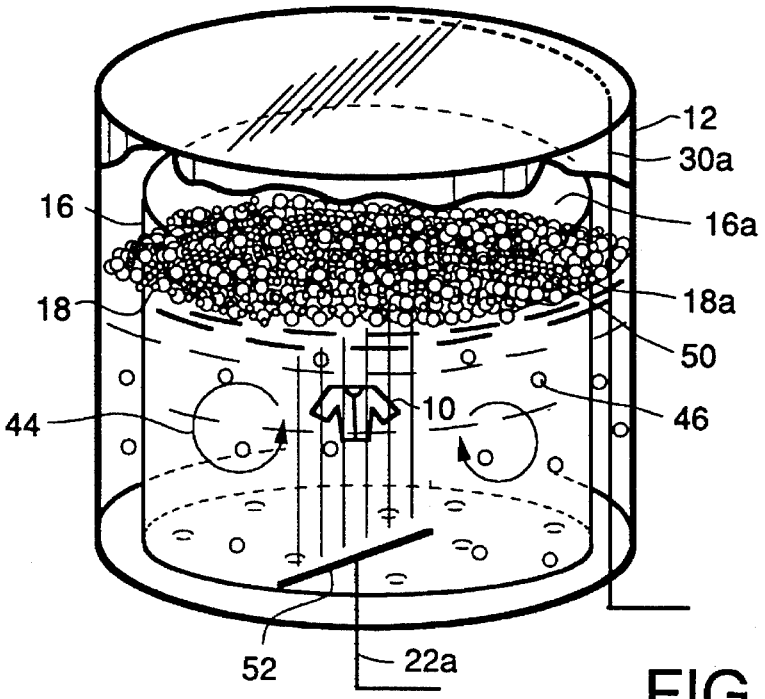
FIG. 3 is a schematic view of a cleaning vessel for dry-cleaning garments and fabrics, used with the apparatus of FIG. 1 and employing as a garment agitation means, jet(s) of liquid carbon dioxide through one, or a plurality of inlet nozzles, with the nozzle(s) configured such as to promote the tumbling action through agitation of the cleaning medium and thereby tumbling of the garments contained therewithin, above, or in conjunction with the means described above.

In an alternate embodiment shown in FIG. 3, liquid carbon dioxide inflow is provided through one or more nozzles 52 arranged in such a configuration as to promote the tumbling action through agitation of the cleaning medium and thus the garments contained therewithin. This can be accomplished alone, or in conjunction with the "boiling" agitation, as described above. The process sequence is also as described above.

Sonic Agitation

Oriented sonic nozzles 54 can be placed around the internal perforated garment basket 16, as illustrated in FIG. 4. Such nozzles, offered by Sonic Engineering Corporation (Stratford, Conn.), utilize a vibrating reed, or blade, to cause agitation pressure waves and cavitation. These nozzles operate at a frequency ranging between 5 to 1000 Kilohertz (KHz). Sonic agitation can be used alone or in conjunction with any of the two methods described above. Few moving parts are necessary in this configuration, thus reducing maintenance costs.

Liquid Agitation (by stirring)

Alternately, a central Magna-drive impeller 56 located under the mesh garment basket 16 creates the necessary fluid agitation to start garment movement. Agitation can be continuous or intermittent through a magnetically-coupled motor 58, as depicted in FIG. 5. Although it involves a moving part, the load on it (and cost) is not high, since the impeller moves the liquid 18 and not the basket 16 and the garments 10 contained therein. Impeller agitation can be used alone or in conjunction with any of the three methods described above.

Thus, there has been disclosed a method of dry-cleaning of garments and fabrics using liquid carbon dioxide under agitation (gas, liquid, sonic) as aided by the presence of cleaning additives and solvents, such as water. It will be appreciated by those skilled in the art that various modifications and changes of an obvious nature may be made without departing from the scope of the invention, and all such modifications and changes are intended to fall within the scope of the invention, as defined by the appended claims.

What is claimed is:

1. Apparatus for cleaning soiled garments and fabrics by removing soiling substances therefrom, comprising:

(a) a walled vessel for containing liquid carbon dioxide, said walled vessel adapted to withstand a pressure in the range of about 500 to 1,500 psi (35.2 to 105.4 Kg/cm$^2$) and a temperature within the range of about 0° to 50° C.;

(b) inlet means attached to said walled vessel for introducing said liquid carbon dioxide thereinto;

(c) reservoir means for supplying said liquid carbon dioxide to said inlet means;

(d) a means of introducing a cleaning additive or enhancer into said walled vessel;

(e) a stationary perforated lidded drum within said walled vessel for containing said soiled garments and fabrics;

(f) means for directly agitating said liquid carbon dioxide in said walled vessel to thereby agitate said garments and fabrics in said perforated lidded drum, said means comprising at least one means selected from the group consisting of gas, sonic, and liquid agitation;

(g) a liquid level gauge/controller for controlling the level of said liquid carbon dioxide in said walled vessel;

(h) temperature control means associated with said walled vessel for controlling the temperature of said liquid carbon dioxide therewithin;

(i) pressure control means associated with said walled vessel for controlling the pressure of said liquid carbon dioxide therewithin; and (j) outlet means in said walled vessel for removing said liquid carbon dioxide therefrom.

2. The apparatus of claim 1 further comprising a separator for removal of particulates from said liquid carbon dioxide, said separator associated with said outlet means.

3. The apparatus of claim 2 wherein said apparatus comprises a closed, recycling system, wherein said means for providing said liquid carbon dioxide from said reservoir comprises a condenser means between said separator and said reservoir means for ensuring that said carbon dioxide is in its liquid state, said apparatus further comprising a preheater between said reservoir means and said inlet means for controlling the temperature of said liquid carbon dioxide prior to introduction thereof into said walled vessel.

4. The apparatus of claim 3 with said separator between said vessel and said condenser comprises means for (1) removing particulates and organic matter from said liquid carbon dioxide and (2) converting said liquid carbon dioxide to its gaseous state.

5. The apparatus of claim 1 wherein said agitation means comprises means for introducing said liquid at such temperatures that promote the formation of $CO_2$ bubbles due to boiling and the liquid $CO_2$ boiling provides mechanical agitation.

6. The apparatus of claim 1 wherein said agitation means comprises a plurality of inlet nozzles arranged in a staged configuration such that flow of liquid carbon dioxide impinges on said garments and fabrics from angles such as to promote tumbling.

7. The apparatus of claim 1 wherein said agitation means comprises a central impeller within said walled vessel beneath said perforated drum to agitate said liquid carbon dioxide.

8. The apparatus of claim 1 wherein said agitation means comprises sonic nozzles placed within said walled vessel to provide sonic agitation.

9. The apparatus of claim 1 wherein said agitation means provides intermittent agitation of said garments and fabrics.

10. The apparatus of claim 1 wherein said agitation means provides continuous agitation of said garments and fabrics.

11. A process for cleaning soiled garments and fabric materials by removing soiling substances therefrom, comprising the steps of:

(a) placing said soiled materials in a stationary perforated drum within a walled vessel, said walled vessel provided with agitation means selected from the group consisting of gas, sonic, and liquid agitation;

(b) introducing into said walled vessel a cleaning fluid, comprising liquid carbon dioxide and, optionally, up to about 5 wt % of at least one cleaning enhancer, and contacting said soiled materials with said cleaning fluid;

(c) simultaneously contacting said soiled materials in said walled vessel with said cleaning fluid and directly agitating said cleaning fluid to thereby agitate said soiled materials for a period of time sufficient to clean said materials.

12. The process of claim 11 wherein said soiling substances comprise at least one of soluble substances and insoluble particulates.

13. The process of claim 11 further comprising the step of, following said contacting step, treating said liquid carbon dioxide containing said soiling substances to remove said soiling substances and returning said treated liquid carbon dioxide to said walled vessel.

14. The process of claim 13 wherein said liquid carbon dioxide is treated by at least one of decompression and filtration.

15. The process of claim 14 wherein said liquid carbon dioxide is decompressed to form a gas and to allow said soiling substances and any cleaning enhancers and any solvents to separate from said gas, and said gas is then recompressed to generate said liquid carbon dioxide.

16. The process of claim 11 wherein said liquid carbon dioxide has a temperature within the range of about 0° to 50° C. and a pressure of within the range of about 500 to 1,500 psi (35.2 to 105.4 $Kg/cm^2$).

17. The process of claim 16 wherein said liquid carbon dioxide has a temperature within the range of about 0° to 30° C. and a pressure of within the range of about 500 to 1,000 psi (35.2 to 70.3 $Kg/cm^2$).

18. The process of claim 11 wherein said at least one cleaning enhancer is selected from the group consisting of surfactants and solvents.

19. The process of claim 18 wherein said solvent consists essentially of water.

* * * * *